US007938109B1

(12) United States Patent
Larson

(10) Patent No.: US 7,938,109 B1
(45) Date of Patent: May 10, 2011

(54) SYNCHRONIZING PULLEY ASSEMBLY FOR COMPOUND ARCHERY BOW

(75) Inventor: Marlow W. Larson, Ogden, UT (US)

(73) Assignee: Larson Archery Company, Ogden, UT (US)

( * ) Notice: Subject to any disclaimer, the term of this patent is extended or adjusted under 35 U.S.C. 154(b) by 518 days.

(21) Appl. No.: 12/077,372

(22) Filed: Mar. 19, 2008

Related U.S. Application Data

(63) Continuation-in-part of application No. 11/241,030, filed on Sep. 30, 2005, now Pat. No. 7,441,555.

(51) Int. Cl.
*F41B 5/10* (2006.01)

(52) U.S. Cl. ..... 124/25.6

(58) Field of Classification Search ..... 124/25.6, 124/900
See application file for complete search history.

(56) References Cited

U.S. PATENT DOCUMENTS

| | | | | |
|---|---|---|---|---|
| 3,486,495 | A | 12/1969 | Allen | |
| 3,990,425 | A | 11/1976 | Ketchum | |
| 4,748,962 | A | 6/1988 | Larson | |
| 4,774,927 | A | 10/1988 | Larson | |
| 4,967,721 | A | 11/1990 | Larson | |
| 5,535,727 | A * | 7/1996 | Helmuth | 124/25.6 |
| 5,687,703 | A * | 11/1997 | Vyprachticky | 124/25.6 |
| 5,791,323 | A * | 8/1998 | Dunlap | 124/25.6 |
| 6,247,466 | B1 * | 6/2001 | McPherson | 124/25.6 |
| 6,415,780 | B1 | 7/2002 | Proctor | |
| 6,763,818 | B2 | 7/2004 | Larson | |
| 6,966,314 | B2 | 11/2005 | McPherson | |
| 6,990,970 | B1 | 1/2006 | Darlington | |

* cited by examiner

*Primary Examiner* — John Ricci
(74) *Attorney, Agent, or Firm* — Brian C. Trask

(57) ABSTRACT

A rigging structure for a compound archery bow includes first and second pulley assemblies, pivotally mounted on axles at tips of corresponding first and second limbs of a compound bow and interconnected by cables. Each pulley assembly includes a dynamic synchronizing component, decoupled from the string and cable pulley components of the assembly.

19 Claims, 5 Drawing Sheets

SYNCHRONIZING PULLEY ASSEMBLY FOR COMPOUND ARCHERY BOW

PRIORITY CLAIM

This application is a continuation-in-part of U.S. patent application Ser. No. 11/241,030, filed Sep. 30, 2005 now U.S. Pat. No. 7,441,555, titled "SYNCHRONIZED COMPOUND ARCHERY BOW", and commonly assigned, copending U.S. patent application Ser. No. 12/074,930 filed Mar. 7, 2007, titled "PULLEY ASSEMBLY AND AXLE FOR COMPOUND BOWS", the entire disclosures of which are hereby incorporated herein by reference.

BACKGROUND OF THE INVENTION

1. Field

This invention relates to compound archery bows. It is particularly directed to an improved pulley assembly for such bows.

2. State of the Art

Compound archery bows commonly carry assemblies of pulley members (usually called "eccentrics" or "cams") eccentrically mounted on axles in association with respective bow limbs. These limbs extend in opposite directions from a grip (usually comprising a central portion of a handle riser). The rigging for compound bows includes a bowstring trained around the pulley members of the system, the string being received by grooves or other functionally equivalent features at the perimeters of the pulleys. The eccentric pulley assemblies are conventionally mounted to rotate (pivot) on a stationary axle within a notch at the distal end of the limb, or within a bracket structure carried by the limb tip. The eccentrics include one or more pivot holes substantially offset from center, whereby to provide for a reduction in the holding force felt at the nocking point of the bowstring, as the string is moved to its fully drawn condition. The term "stationary axle" is intended to connote axles upon which pulley assemblies are free to pivot, in contrast to axles that themselves significantly and unavoidably rotate around a central axis (e.g. more than 180 degrees). In practice, it is normally immaterial to the operation of an archery bow whether an axle deemed stationary in this context actually rotates to some extent.

Compound bows and various exemplary riggings, including pulley assemblies, are described by U.S. Pat. Nos. 3,486,495; 3,990,425; 4,748,962; 4,774,927; 4,967,721 and 6,763,818, the disclosures of which are incorporated as a portion of this disclosure as general background concerning conventional constructions.

U.S. Pat. Nos. 3,990,425 and 6,990,870 propose rigging systems that cross-couple the pulley assembles of a compound bow so that they are constrained to move in unison, thereby providing a self-tuning function to the bow. The term "cross-couple" (sometimes "cross-coupling," or "cross-coupled") designates a rigging in which the cable end conventionally attached to the pulley axles are instead attached to a synchronizing sheave of the pulley assembly.

The '425 patent discloses pulley assemblies in which cross-coupling is accomplished through an anchoring arrangement that inherently imparts a leaning moment to the pulley assemblies. Specifically, the cables are all disposed to one side of the bowstring. The '870 patent disclosure includes riggings configured to apply cable forces more evenly, thereby reducing the twisting moment applied to the mounting axle of the assembly. Moreover, the '870 patent discloses cross-coupled pulley assemblies within the riggings of single-cam compound bows. In any case, the synchronizing pulley components incorporated into pulley assemblies to date have been integral; that is, they are fixed to the other components of the assembly and turn (pivot) in unison with the bowstring and cable pulley components The conventional practice in constructing compound bows has been to mount all pulley components onto stationary axles. Originally, the pulleys were provided with bushings, rotatably mounted on an axle. More recently, these bushings have been replaced with bearing assemblies of various kinds, Exemplary bearing arrangements for compound bows are described and illustrated by U.S. Pat. No. 6,415,780, the disclosure of which is incorporated by reference for its description of such bearing arrangements and the advantages they offer. Commonly assigned, copending patent application Ser. No. 12/074,930 filed Mar. 7, 2007, discloses journal mounted axles integral with pulley assemblies. These arrangements accommodate increased spacing of bearing assemblies, further resisting the twisting moments applied to the assemblies during a shooting cycle.

SUMMARY OF THE INVENTION

This invention provides a pulley assembly for compound bows that includes synchronizing components that are decoupled from associated string and cable pulley components. The string and cable components of the assemblies may be fixed to integral axles or they may be mounted to pivot around stationary axles. An integral axle may be structured for journal mounting at its opposite ends in bushing or bearing assemblies carried by a limb tip. Spaced placement of the journal mountings effectively resists tilting of the pulley assembly, thereby significantly reducing the annoyance experienced as a consequence of such tilting. The synchronizing component most often constitutes a spooling device, such as a single groove pulley mounted to pivot on the axle. It may be journal mounted to pivot on a bushing or bearing assembly carried by the axle.

As used in this disclosure, the term "journal mounted" refers to a pivot-enabling interconnection of one structural element to another. Most often, that interconnection is effected by a simple bore hole, a bushing or a bearing set (including ball or roller bearings). In this context, a "journal mounted" axle is journalled within one or more fixtures that permit the axle to pivot or rotate around its axis of rotation. A "journal mounted" synchronizing pulley element typically includes, or is associated with, a fixture (such as a pillow block bearing) through which an axle is journalled.

It is within contemplation that a synchronizing pulley element may be journal mounted to an axle that is itself journal mounted. The term "decoupled," as used in this disclosure, refers to arrangements in which a synchronizing component, (such as a pulley), lacks direct physical attachment to the other pulley components (typically, to the bowstring and cable pulley members) of the pulley assembly. It is recognized that rotation of the string pulley component will inevitably have some impact upon the operation of an associated synchronizing component because of the interconnection of these components by the cable means (string and cable segments) of the rigging. Nevertheless, the decoupled synchronizing component is not constrained to move through the same angular displacement as the string pulley component. Neither is it constrained to pivot in the same direction as the string pulley component rotates during a shooting cycle.

The terms "fixed to" or "integral with" denote components that are held together in a fashion comparable to being machined from a single mass of material. For example, a pulley component may be fixed to an axle by mating a section of axle having a polygonal cross section to a passageway of similar size and shape through the pulley component. An axle is regard as integral with a pulley component if an angular displacement of the pulley component around its axis of rotation causes a simultaneous similar angular displacement of the axle around that axis.

The pulley assemblies of this invention can be included in any archery device, including traditional compound bows, cross bows and single cam bows capable of utilizing cross coupled riggings. Each assembly includes a string pulley component with a peripheral string groove. A cable pulley component, having a peripheral cable take-up grove is disposed approximately parallel, but usually spaced from, the string pulley. A dynamic synchronizing anchor component is also present in decoupled operable association with the string and cable pulley components.

While other configurations are operable, the preferred rigging of this invention includes first and second synchronizing cable segments, each of which includes a first (take-up) end and a second (synchronizing) end. The first synchronizing cable segment is anchored to a first one of the pulley assemblies in position to wrap onto the peripheral cable take-up groove (or functionally equivalent structure) of that assembly. The opposite (synchronizing) end of the first cable segment is anchored to the dynamic synchronizing anchor component of the other pulley assembly. The second synchronizing cable segment is attached to the second pulley assembly in position to wrap into the peripheral cable take-up groove of that assembly. The opposite end of the second cable segment is anchored to the dynamic synchronizing component of the first pulley assembly.

The entire rigging is thus constructed and arranged such that as the bowstring is pulled, its opposite ends (or cable segments attached to those ends) unwrap from the rotating peripheral string grooves of the assemblies. Concurrently, the peripheral cable grooves (or functionally equivalent structure) of the assemblies take up (or alternatively, wrap) portions of the first ends of the respective synchronizing cables. According to the presently preferred embodiments of this invention, relatively small lengths of the opposite (synchronizing) ends of the synchronizing cables are released from the synchronizing elements of the respective pulley assemblies as relatively longer lengths of the take-up ends are wrapped onto the cable up-take grooves of the respective opposite pulley assemblies. Of course, these relationships are subject to adjustment as required to obtain preferred force draw characteristics for a particular bow.

The pulley assemblies may be structured with sufficient width to permit passage of a launched arrow between the cables, without the use of a cable guard. In certain embodiments, however, cable-spreading structure is positioned between the cable segments located on opposite sides of the bowstring. Such cable spreading structure may be mounted to extend from the handle riser to between cable stretches located to the right and left of the bowstring. Certain embodiments of the pulley assemblies, particularly those that position all of the cables to one side of the bowstring, are quite narrow, however. Use of a cable guard is generally preferred in those arrangements.

The dynamic synchronizing anchor components of this invention may take various structural forms, provided they effect a dynamic connection of a synchronizing cable segment to a pulley assembly. In the context of this disclosure, a "dynamic" connection is one that operates to change the length of the synchronizing cable as the nocking point is drawn, (ignoring the simultaneous change in length effected by wrapping of the take-up end of that cable onto a take-up groove. A typical such anchor component permits a portion of the cable segment to pay out from (or retrieve into) a pulley assembly as the bowstring is pulled.

While more elaborate structures can be envisioned, a simple small diameter drum, pulley or equivalent spooling member has been found to be adequate in practice to serve as a dynamic synchronizing component. The synchronizing pulley components of this invention are rotationally decoupled from the other pulley components of the assembly. The synchronizing spooling surface or groove may be either concentric or eccentric with respect to the mounting axle of the pulley assembly. In any case, the working portions of the respective spooling surfaces (or equivalent pay out devices) must be synchronized; that is, release (or retrieve) practically identical lengths of synchronizing cable for any drawn distance of the bowstring. The synchronizing end of a cable segment may thus be wrapped around the perimeter of a dynamic anchor pulley, or equivalent spooling structure, terminating in an attachment to the pulley assembly itself, or other structure associated with a bow. Synchronizing of spooling surfaces is less challenging if those surfaces (or grooves) are circular and concentric with respect to the pivot axles of the pulley assemblies. Nevertheless, non-circular spooling surfaces of some synchronizer pulley members may be preferred in certain instances to achieve particular shooting characteristics for a bow.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Figure 1:
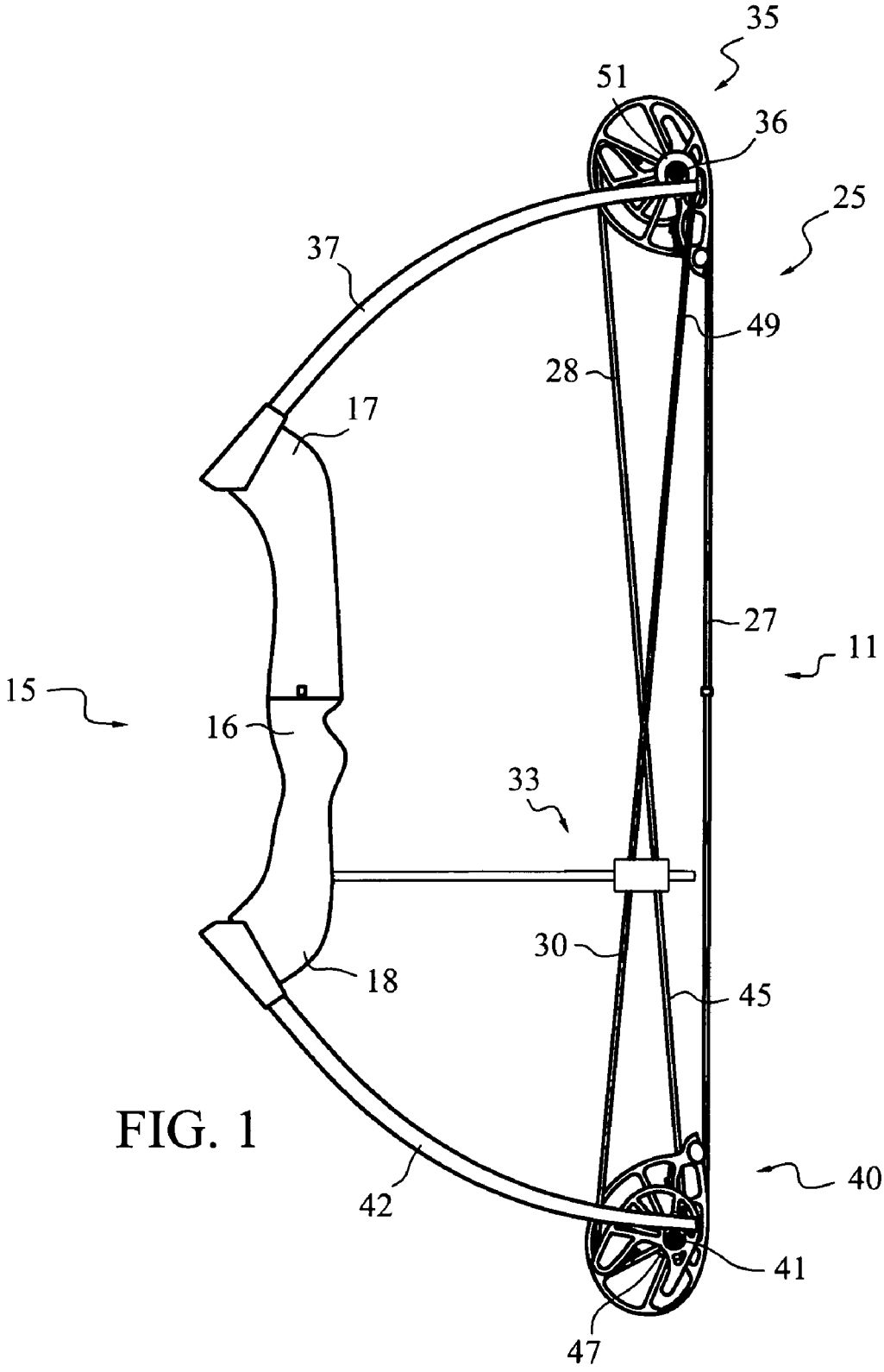
FIG. 1 is a side view of an archery bow of this invention in "braced" or relaxed condition.

The compound bow, generally 11, illustrated by FIG. 1, is of generally conventional construction. It includes a handle riser component, generally 15, with a grip 16, an upper end 17 and a lower end 18. The rigging, generally 25, includes a bowstring 27, and two synchronizing cables 28, 30. The cables 28, 30 are held away from the operating plane of the bowstring 27 by a cable guard assembly, generally 33. An upper pulley assembly, generally 35, includes an integral pivot axle 36 mounted at the tip of an upper limb 37. A lower pulley assembly, generally 40, similarly includes an integral pivot axle 41 mounted at the tip of a lower limb 42. The rigging 25 is arranged generally as described by copending U.S. patent application Ser. No. 11/241,030, with the synchronizing end 45 of the cable 28 being trained partially around a synchronizing pulley component 47 (disposed on the opposite side of illustrated assembly 40 in FIG. 1). Similarly, the synchronizing end 49 of the cable 30 is anchored at an operable location at brace condition after being trained partially around a synchronizing pulley component 51 of pulley assembly 35.

Figure 3:
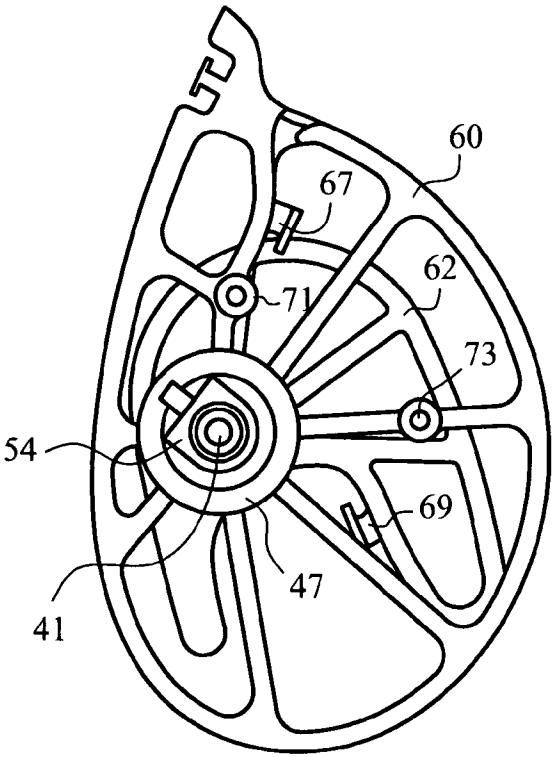
FIG. 3 is a side view of the assembly of FIG. 2, rotated 90 degrees to the left about an imaginary vertical axis.

In the pulley embodiments illustrated in FIG. 1, the respective axles, 36, 41, are journal mounted at their respective opposite ends in bearing assemblies 54 (see FIG. 3). The synchronizing pulleys 47, 51 are similarly journal mounted to respective axles, 36, 41. They are thus rotationally decoupled from the other components of the pulley assemblies 35, 40.

Figure 4:
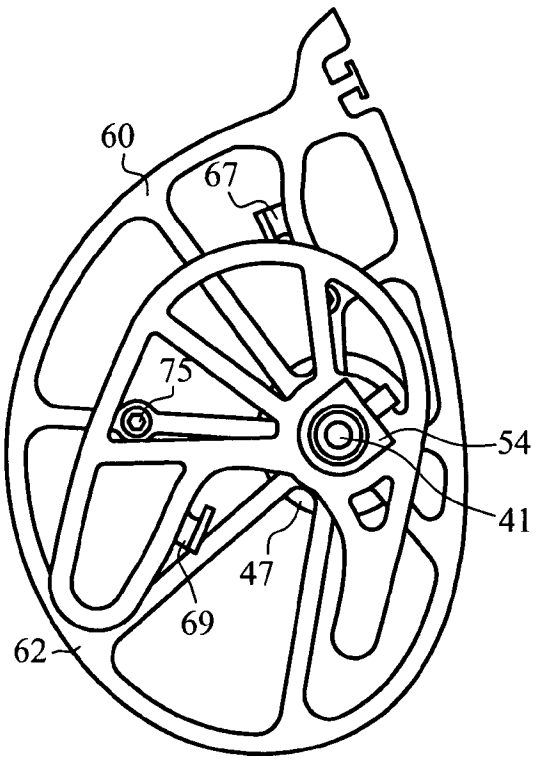
FIG. 4 is a side view of the assembly of FIG. 2, rotated 90 degrees to the right about the same imaginary vertical axis.
Figure 2:
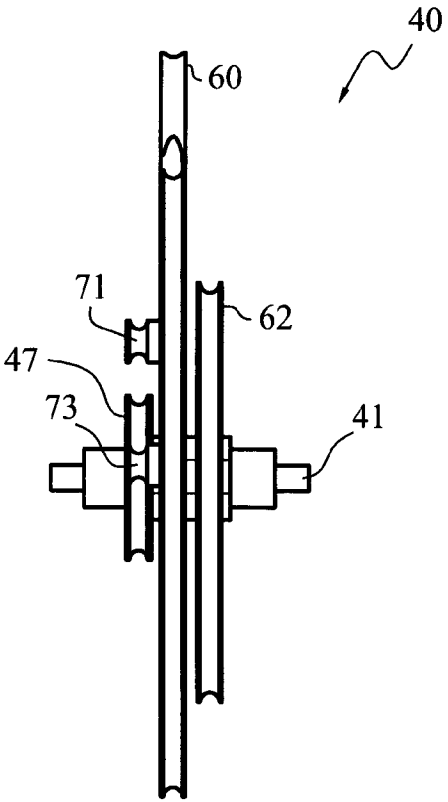
FIG. 2 is a view in front elevation of the lower pulley assembly illustrated in FIG. 1 with the mountings removed.

FIGS. 2 through 4 illustrate details of construction of the lower pulley assembly 40 in FIG. 1. Pulley assembly 40 includes a bowstring cam 60, a dynamic anchor cam 47, and a cable cam 62. Cams 60 and 62 are installed integral with the axle 41 (e.g. press-fit onto the hexagonal cross-section portion of axle 41). Therefore cams 60, 62 inevitably rotate in unison with the axle 41. The dynamic anchor cam 47 is journal mounted on axle 41, but is mounted in such a way as to permit its rotation with respect to the axle and therefore independent from, or rotationally decoupled from, the other cams 60, 62. Desirably, opposite ends of axle 41 are journal mounted for rotation in mountings 54, which typically include bearing or bushing elements to reduce rotational friction.

In alternative operable embodiments, cams 60, 62 may be journaled to permit their rotation about axle 41. In that case, the axle can even be mounted on a bow limb to resist rotation of the axle. In any case, the cams 60, 62 are still rotationally coupled to each other and rotationally decoupled from the dynamic anchor cam 47.

With particular reference to FIGS. 2-4, pulley assembly 40 includes an anchor 67 disposed on bowstring pulley 60 and adapted to hold one end of the bowstring 27. A cable anchor 69 is carried on cable pulley 62, and holds one terminal end of cable 30 effective to permit spooling cable 30 onto cam 62 during draw of an arrow. As illustrated, one or more of (optional) cable anchor 71 and/or 73 may be carried on cable cam 62 in position effective to permit spooling end 45 of cable 28 onto dynamic anchor cam 47. An anchor, such as anchor 73, may be associated with a cam, such as cam 62, using a fastener 75 (FIG. 4). To resist fray at the cable end, it is desirable for an anchor, such as anchor 73, to be journal mounted to permit its rotation about an axis of fastener 75.

Figure 6:
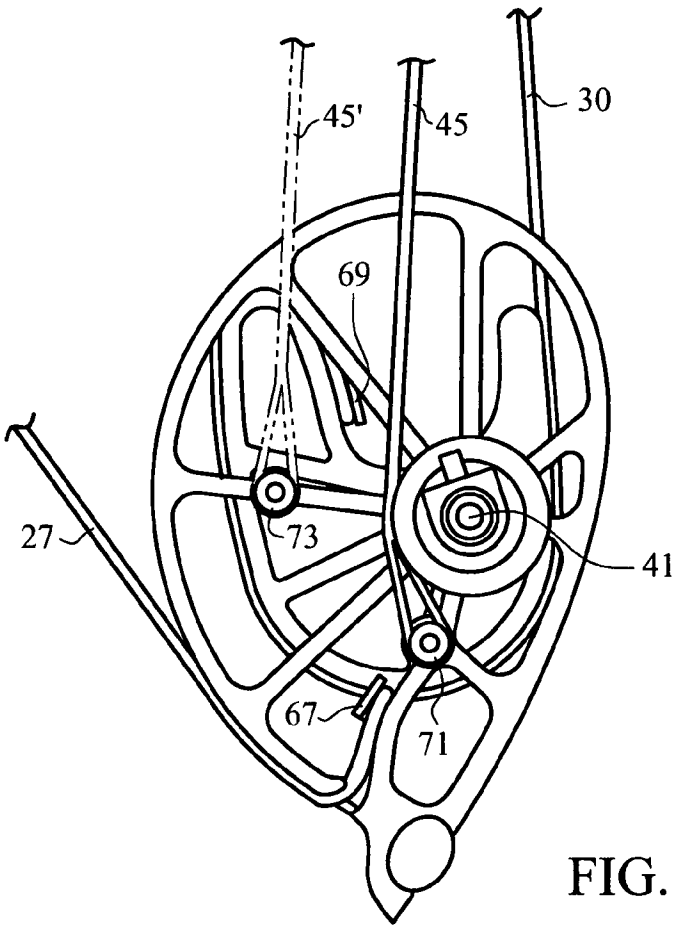
FIG. 6 is the pulley of FIG. 5, but rotated to full-draw condition.
Figure 5:
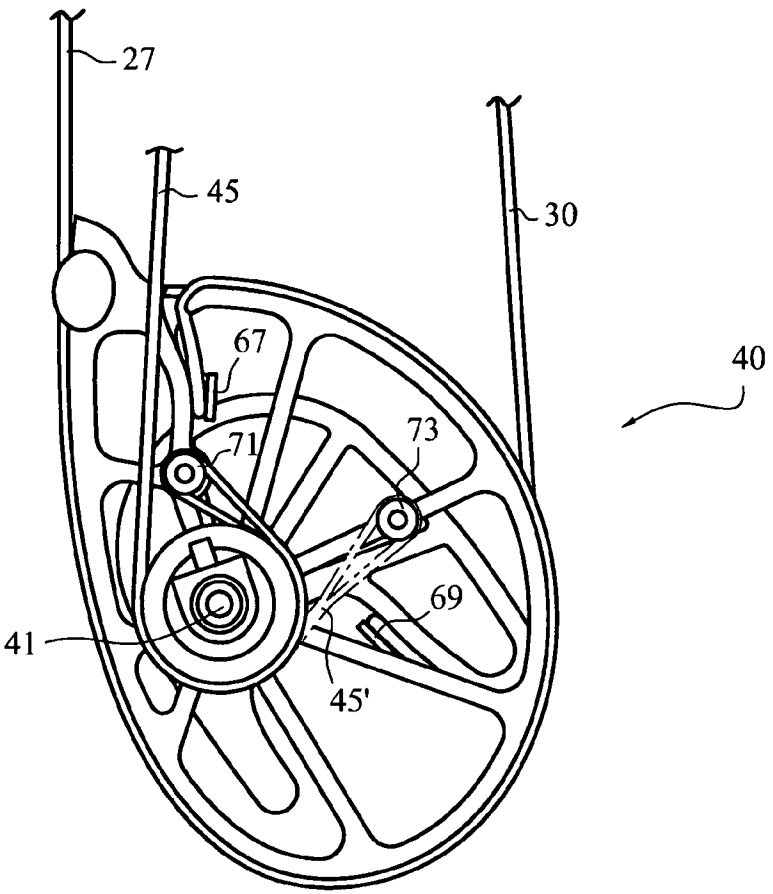
FIG. 5 is a side view close-up of a pulley assembly at brace condition.

With reference now to FIGS. 5 and 6, it can be seen that the degree, or amount, of spooling (in or out) of cable end 45 around dynamic anchor 47 can be controlled by the position of that cable's anchor. For example, when end 45 is affixed to anchor 71, a portion of cable end 45 remains in contact with the working surface of dynamic anchor pulley 47 during the entire draw motion from brace condition. However, when that same cable end (represented by cable designated 45' and indicated in phantom) is anchored at anchor 73, cable 45' is out of registration with pulley 47 during the latter portion of the draw motion. During that non-contacting portion of the draw, the dynamic anchor pulley 47 is no longer paying out any length of cable end 45. The length of cable end 45 that is "paid out" during such non-contacting portion of the draw is governed by geometric principles and factors such as the distance of anchor 73 from the center of axle 41, and incremental bending of the bow limb on which the assembly is mounted.

Figure 7:
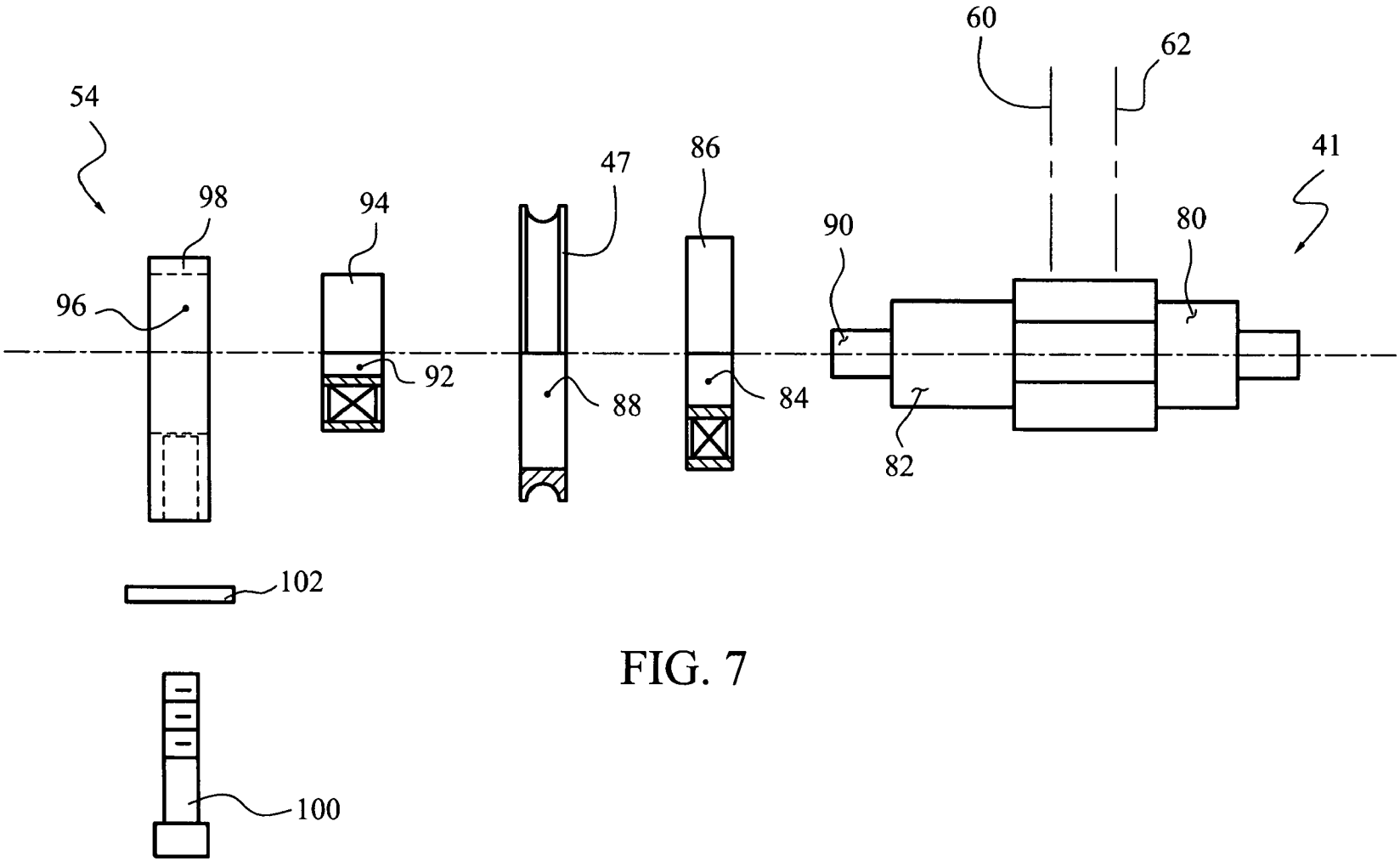
FIG. 7 is an exploded assembly view representative of the axle and a portion of the pulley assembly illustrated in FIG. 2.

Details of construction of an exemplary portion of a pulley assembly, such as assembly 40, are illustrated in FIG. 7. Axle 41 desirably includes a noncircular portion, such as illustrated octagonal portion 80, onto which may be affixed the bowstring cam and cable cam (represented by centerlines 60 and 62, respectively). A cylindrical portion 82 is sized for journal mounted reception inside bore 84 through bearing 86. Dynamic anchor pulley 47 receives bearing 86 in press-fit journal mounted engagement inside bore 88. Therefore, the dynamic anchor pulley 47 is rotationally decoupled from cams 60, 62. A bearing surface 90 of axle 41 is then journal mounted into bore 92 of bearing 94. Bearing 94 is receive in bore 96 in housing 98 of mounting assembly 54. The mounting assembly 54 may advantageously be affixed to a bow limb by way of trapping a portion of the limb tip between housing 98 and a fastener 100 (and optional washer 102).

Figure 8:
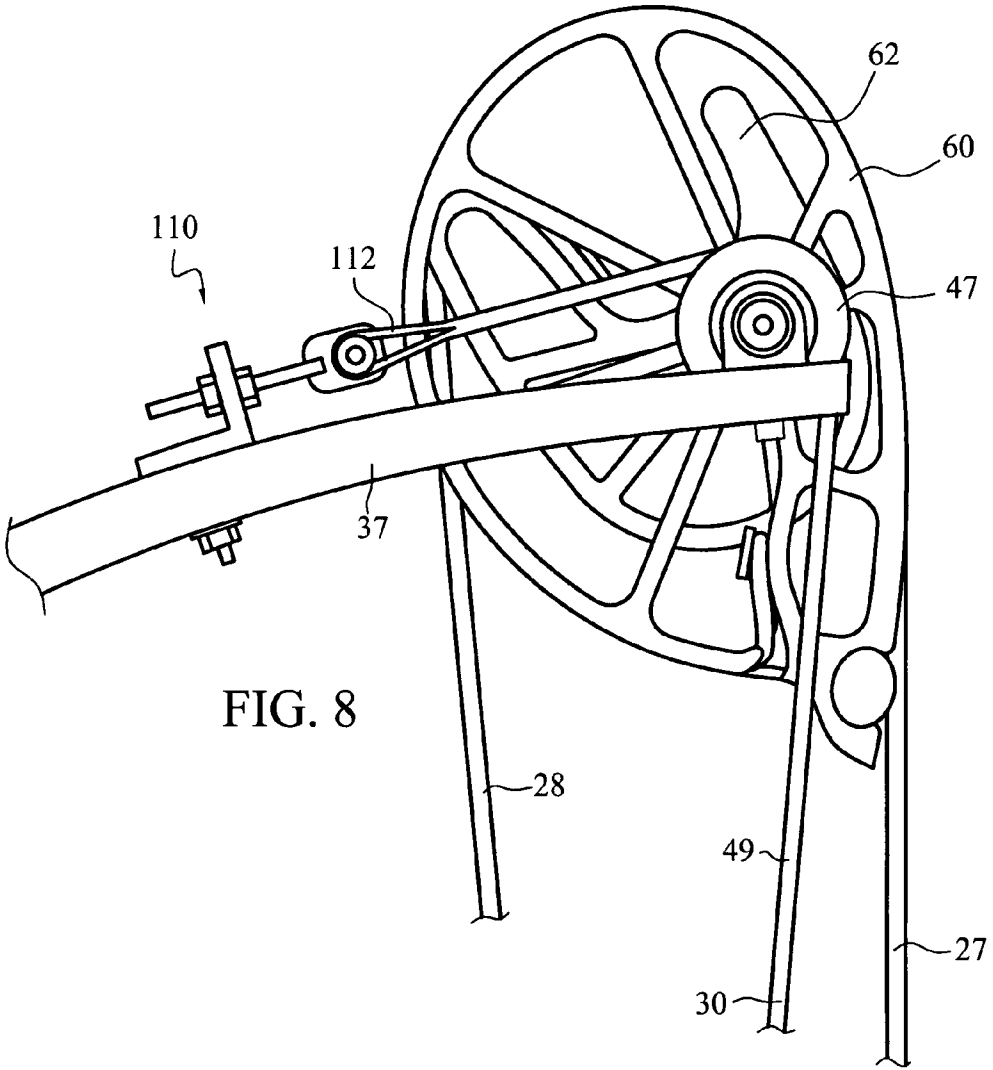
FIG. 8 is a side view of a pulley assembly similar to those illustrated in FIGS. 1-6, and including an alternative rigging anchor arrangement.

FIG. 8 illustrates an alternative anchoring arrangement, generally 110, for terminal end 112 of cable 30. End 49 of cable 30 is trained around dynamic anchor pulley 47, and secured by anchor 110 to limb 47. Rotation of anchor pulley 47 is decoupled from rotation of pulleys 60, 62. Therefore, the amount of cable end 49 that is "paid out" from pulley 47 is governed by incremental bending of the bow limb on which the assembly is mounted, but is independent of rotation of pulleys 60, 62.

What is claimed is:

1. Rigging for a compound archery bow comprising:

first and second pulley assemblies, mounted to rotate about respective axes at tips of corresponding first and second limbs of a compound bow; each assembly including:

a string pulley component having a peripheral string groove; and a cable pulley component having a peripheral cable take-up groove;

said string and cable pulley components being structured and arranged to pivot in unison; and a synchronizing pulley component, having a peripheral groove, structured and arranged to pivot independently with respect to said string and cable pulley components.

2. Rigging according to claim 1, wherein respective said string pulley components are fixed to respective axles and respective said cable pulley components are also fixed to said axles.

3. Rigging according to claim 2, wherein opposite ends of each of said axles are journal mounted in bearing assemblies carried by respective limbs of an archery bow.

4. Rigging according to claim 3, wherein said synchronizing pulleys are journal mounted on said axles.

5. Rigging according to claim 1, wherein said string and cable pulley components are integral.

6. A compound archery bow that includes:

a handle having projecting limbs;

a first pulley assembly, with an integral axle, mounted on a first of said limbs for rotation around a first axis;

a second pulley assembly, with an integral axle, mounted on a second of said limbs for rotation around a second axis; and bow cable means including a bowstring cable extending from bowstring let-out grooves of said first and second pulley assemblies, a first cable extending from a cable take-up groove of said first pulley assembly to second cable let-out means mounted to rotate on said second axis, and a second cable extending from a cable take-up groove of said second pulley assembly to first cable let-out means mounted to turn on said first axis such that draw of said bowstring cable away from said handle lets out bowstring cable from said let-out grooves on said first and second pulley assemblies, rotates said first and second pulley assemblies around said axes, and lets out portions of said first and second cables from said first and second cable let-out means on said first and second pulley assemblies;

wherein said first and second cable let out means are decoupled from said bowstring let-out grooves of said first and second pulley assemblies.

7. A compound archery bow according to claim 6, wherein the opposite ends of each of said axles of said first and second pulley assemblies are journal mounted in bearing assemblies carried at the distal ends of respective said limbs.

8. Rigging for a compound archery bow comprising:

first and second pulley assemblies, mounted to pivot on respective axles at tips of corresponding first and second limbs of a compound bow; each assembly including:

a string pulley component with a peripheral string groove;

a cable pulley component with a peripheral cable take-up groove;

an axle fixed to said string pulley and said cable pulley; and a dynamic synchronizing component decoupled from said string pulley component;

a bowstring with opposite ends connected to said first and second pulley assemblies such that, at rest condition of the bow, the peripheral string grooves are substantially occupied by wrapped bowstring;

a first cable segment, extending from the entry of the peripheral cable take-up groove of said first assembly to said synchronizing component of said second pulley assembly; and a second cable segment, extending from the entry of the peripheral cable take-up groove of said second assembly to said synchronizing component of said first pulley assembly;

said first and second pulley assemblies being structured and arranged such that as said bowstring is pulled from its said rest position towards its drawn position, respective first ends of said first and second cable segments wrap onto the peripheral cable take-up grooves of said first and second pulley assemblies, respectively, and respective second ends of said first and second cable segments operably interact with the dynamic synchronizing components of said second and first pulley assemblies, respectively.

9. Rigging according to claim 8, wherein said peripheral string groove is non-circular in configuration.

10. Rigging according to claim 8, wherein said peripheral cable groove is non-circular in configuration.

11. Rigging according to claim 10, wherein said cable groove is out of registration with said string groove.

12. In a pulley assembly for a compound bow of the type in which the assembly includes multiple pulley components mounted to pivot around an axis, the improvement comprising:

a string pulley component and a cable pulley component structured and arranged to pivot together around said axis; and a synchronizing component structured and arranged to pivot around said axis independent of said string and cable pulley components.

13. An improvement according to claim 12, wherein said pulley assembly includes a string pulley component fixed to a cable pulley component.

14. An improvement according to claim 13, including an axle fixed to said string and cable pulley components.

15. An improvement according to claim 14, including a synchronizing pulley component journal mounted to said axle.

16. An improvement according to claim 13, wherein said string and cable pulley components are journal mounted to an axle and said pulley assembly further includes a synchronizing pulley component journal mounted to said axle.

17. Rigging for a compound archery bow comprising:

first and second pulley assemblies, mounted to rotate about respective axes at tips of corresponding first and second limbs of a compound bow; each assembly including:

a string pulley component having a peripheral string groove and a cable pulley component having a peripheral cable take-up groove, said string and cable pulley components being fixed to an axle such that they pivot in unison; and a synchronizing pulley component, having a peripheral groove, structured and arranged to pivot independently with respect to said string and cable pulley components.

18. Rigging according to claim 17, wherein opposite ends of each of said axles are journal mounted in bearing assemblies carried by respective limbs of an archery bow.

19. Rigging according to claim 17, wherein said synchronizing pulleys are journal mounted on said axles.

* * * * *

US007938109C1

(12) INTER PARTES REEXAMINATION CERTIFICATE (1154th)

United States Patent
Larson

(10) Number: US 7,938,109 C1
(45) Certificate Issued: Aug. 13, 2015

(54) SYNCHRONIZING PULLEY ASSEMBLY FOR COMPOUND ARCHERY BOW

(75) Inventor: Marlow W. Larson, Ogden, UT (US)

(73) Assignee: LARSON ARCHERY COMPANY, Ogden, UT (US)

Reexamination Request:
No. 95/002,395, Sep. 15, 2012

Reexamination Certificate for:

| | |
|---|---|
| Patent No.: | **7,938,109** |
| Issued: | **May 10, 2011** |
| Appl. No.: | **12/077,372** |
| Filed: | **Mar. 19, 2008** |

Related U.S. Application Data

(63) Continuation-in-part of application No. 11/241,030, filed on Sep. 30, 2005, now Pat. No. 7,441,555.

(51) Int. Cl.
*F41B 5/10* (2006.01)

(52) U.S. Cl.
CPC ..... *F41B 5/105* (2013.01)

(58) Field of Classification Search
None
See application file for complete search history.

(56) References Cited

To view the complete listing of prior art documents cited during the proceeding for Reexamination Control Number 95/002,395, please refer to the USPTO's public Patent Application Information Retrieval (PAIR) system under the Display References tab.

*Primary Examiner* — Jeffrey R Jastrzab

(57) ABSTRACT

A rigging structure for a compound archery bow includes first and second pulley assemblies, pivotally mounted on axles at tips of corresponding first and second limbs of a compound bow and interconnected by cables. Each pulley assembly includes a dynamic synchronizing component, decoupled from the string and cable pulley components of the assembly.

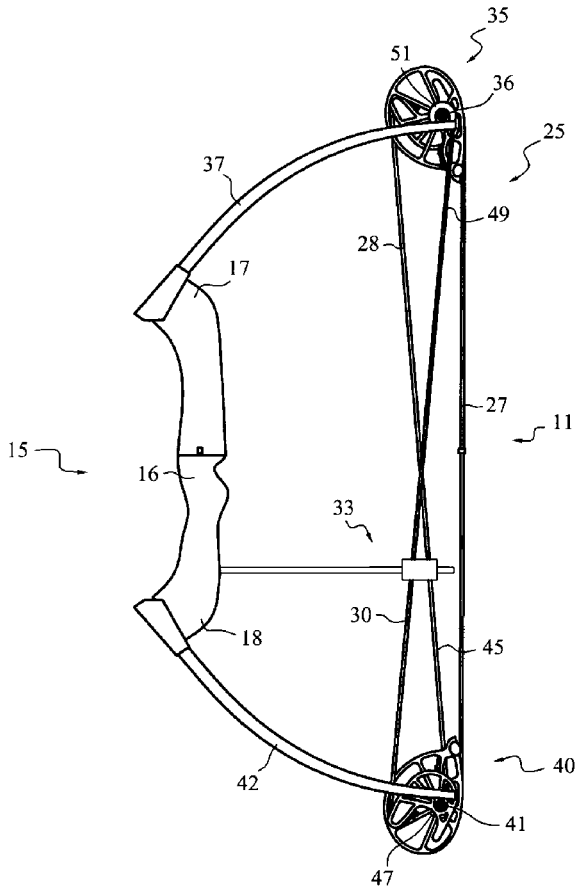

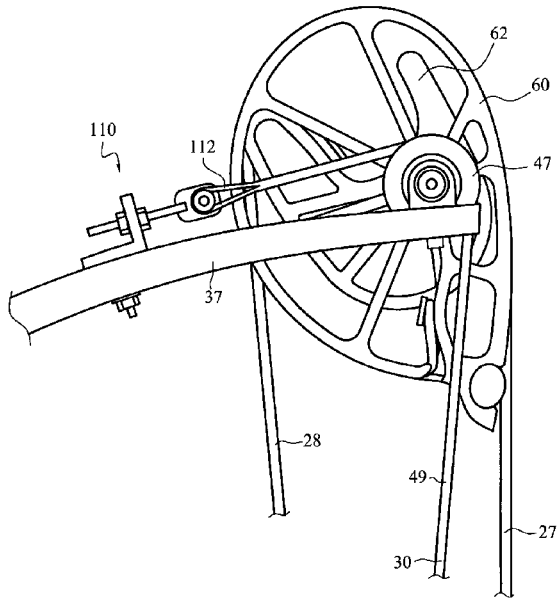

INTER PARTES REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 6, 8, 12 and 17 are determined to be patentable as amended.

Claims 2-5, 7, 9-11, 13-16, 18 and 19, dependent on an amended claim, are determined to be patentable.

New claims 20 and 21 are added and determined to be patentable.

1. Rigging for a compound archery bow comprising:

first and second pulley assemblies, mounted to rotate about respective axes at tips of corresponding first and second limbs of a compound bow; each assembly including:

a string pulley component having a peripheral string groove; and a cable pulley component having a peripheral cable take-up groove;

said string and cable pulley components being structured and arranged to pivot in unison; [and]

a synchronizing pulley component, having a peripheral groove, structured and arranged to pivot independently with respect to said string and cable pulley components*; and*

*a first anchor positioned to secure one end of a first cable in operable association with the peripheral groove of said cable pulley component, a second anchor positioned to secure one end of a second cable in operable association with said synchronizing pulley component, and a third anchor positioned to secure one end of a bowstring in operable association with the peripheral groove of said string pulley component.*

6. A compound archery bow that includes:

a handle having projecting limbs;

a first pulley assembly, with an integral axle, mounted on a first of said limbs for rotation around a first axis;

a second pulley assembly, with an integral axle, mounted on a second of said limbs for rotation around a second axis; and bow cable means including a bowstring cable extending from bowstring let-out grooves of said first and second pulley assemblies, a first cable extending from a cable take-up groove of said first pulley assembly to second cable let-out means mounted to rotate on said second axis, and a second cable extending from a cable take-up groove of said second pulley assembly to first cable let-out means mounted to turn on said first axis such that draw of said bowstring cable away from said handle lets out bowstring cable from said let-out grooves on said first and second pulley assemblies, rotates said first and second pulley assemblies around said axes, and lets out portions of said first and second cables from said first and second cable let-out means on said first and second pulley assemblies;

*each of said first pulley assembly and said second pulley assembly carrying anchor structure for respective opposite ends of said bowstring, said first cable, and said second cable;* wherein said first and second cable let out means are decoupled from said bowstring let-out grooves of said first and second pulley assemblies.

8. Rigging for a compound archery bow comprising:

first and second pulley assemblies, mounted to pivot on respective axles at tips of corresponding first and second limbs of a compound bow; each assembly including:

a string pulley component with a peripheral string groove;

a cable pulley component with a peripheral cable take-up groove;

an axle fixed to said string pulley and said cable pulley; [and]

a dynamic synchronizing component decoupled from said string pulley component; *and*

*a first anchor for connecting one end of a bowstring to said assembly, a second anchor for connecting one end of a first cable to said assembly, and a third anchor for connecting one end of a second cable to said assembly;*

[a] *said* bowstring with opposite ends connected to said first and second pulley assemblies such that, at rest condition of the bow, the peripheral string grooves are substantially occupied by wrapped bowstring;

a first cable segment*, of said first cable*, extending from the entry of the peripheral cable take-up groove of said first assembly to said synchronizing component of said second pulley assembly; and a second cable segment*, of said second cable*, extending from the entry of the peripheral cable take-up groove of said second assembly to said synchronizing component of said first pulley assembly;

said first and second pulley assemblies being structured and arranged such that as said bowstring is pulled from its said rest position towards its drawn position, respective first ends of said first and second cable segments wrap onto the peripheral cable take-up grooves of said first and second pulley assemblies, respectively, and respective second ends of said first and second cable segments operably interact with the dynamic synchronizing components of said second and first pulley assemblies, respectively.

12. In a pulley assembly for a compound bow of the type in which the assembly includes multiple pulley components mounted to pivot around an axis, the improvement comprising:

a string pulley component and a cable pulley component structured and arranged to pivot together around said axis; [and]

a synchronizing component structured and arranged to pivot around said axis independent of said string and cable pulley components*; and*

*a first anchor positioned to secure one end of a first cable in operable association with said cable pulley component, a second anchor positioned to secure one end of a second cable in operable association with said synchronizing pulley component, and a third anchor positioned to secure one end of a bowstring in operable association with said string pulley component; wherein*

*each of said first anchor, said second anchor, and said third anchor are carried on said pulley assembly.*

17. Rigging for a compound archery bow comprising:

first and second pulley assemblies, mounted to rotate about respective axes at tips of corresponding first and second limbs of a compound bow; each assembly including:

a string pulley component having a peripheral string groove and a cable pulley component having a peripheral cable take-up groove, said string and cable pulley components being fixed to an axle such that they pivot in unison; [and]

a synchronizing pulley component, having a peripheral groove, structured and arranged to pivot independently with respect to said string and cable pulley components*; and*

*a first anchor positioned to secure one end of a first cable in operable association with said cable pulley component, a second anchor positioned to secure one end of a second cable in operable association with said synchronizing pulley component, and a third anchor positioned to secure one end of a bowstring in operable association with said string pulley component.*

*20. Rigging according to claim 1, wherein:*

*said string pulley component and said cable pulley component are fixed to an axle;*

*each said string pulley component is structured and arranged to pivot around a respective one of said axes; and*

*said synchronizing pulley component is structured and arranged to pivot around said axle.*

*21. The pulley assembly according to claim 20, wherein:*

*said synchronizing pulley component is journal mounted on said axle.*

* * * * *